US005931302A

United States Patent [19]

Isaacs et al.

[11] Patent Number: 5,931,302

[45] Date of Patent: Aug. 3, 1999

[54] PELLET DISPENSER

[75] Inventors: Linda Robin Fuchs Isaacs; Judah Isaacs, both of Far Rockaway, N.Y.

[73] Assignee: Innovative Premiums Inc., Oceanside, N.Y.

[21] Appl. No.: 09/020,941

[22] Filed: Feb. 9, 1998

[51] Int. Cl.[6] ..... B65D 83/00

[52] U.S. Cl. ..... 206/538; 206/540

[58] Field of Search ..... 206/528, 531, 206/532, 533, 535, 536, 537, 538, 540; 221/25, 88, 87, 262, 273, 130

[56] References Cited

U.S. PATENT DOCUMENTS

| | | | |
|---|---|---|---|
| 3,297,198 | 1/1967 | Wright, Jr. . | |
| 3,332,575 | 7/1967 | Pilot et al. . | |
| 3,348,731 | 10/1967 | Eicholtz et al. | 206/533 X |
| 3,638,603 | 2/1972 | Conover . | |
| 4,207,982 | 6/1980 | Maxwell et al. . | |
| 4,303,173 | 12/1981 | Nergard | 220/264 X |
| 4,432,300 | 2/1984 | Lyss . | |
| 4,489,834 | 12/1984 | Thackrey . | |
| 4,511,050 | 4/1985 | Nicol . | |
| 4,512,500 | 4/1985 | Belbin, Sr. | 206/538 X |
| 4,528,933 | 7/1985 | Allen . | |
| 4,749,093 | 6/1988 | Trick . | |
| 4,753,189 | 6/1988 | Mastman et al. . | |
| 4,782,966 | 11/1988 | Thackrey . | |
| 4,792,664 | 12/1988 | Schwab . | |
| 5,009,338 | 4/1991 | Barker . | |
| 5,188,251 | 2/1993 | Kusz . | |
| 5,261,548 | 11/1993 | Barker et al. . | |

*Primary Examiner*—Jacob K. Ackun
*Attorney, Agent, or Firm*—Helfgott & Karas, P.C.

[57] ABSTRACT

A pellet compartment is separated from an actuator compartment by a partition wall. The pellet compartment communicates with a dispensing port formed in the actuator compartment by way of a truncated spout. A thumb-operated actuator drives a shutter between the dispensing port and the spout and further indexes a wheel to indicate that the dispenser has been actuated. The actuator, shutter and index wheel, as well as a ratchet mechanism engaged with the index wheel, are interconnected by an elastic band.

22 Claims, 3 Drawing Sheets

PELLET DISPENSER

BACKGROUND OF THE INVENTION

1. Field of the Invention

The present invention relates in general to a manually operated container for dispensing pills, tablets, candy or other small objects and in particular to such a container which includes an indicator which is indexed each time the container is actuated.

2. Description of Prior Development

Pill dispensers have long been available in numerous designs and configurations for meeting various purposes. In certain cases it is desirable to provide an indication to the user that a pill has or has not been dispensed.

For example, if a particular medication is to be taken daily, it is helpful to the user if a pill dispenser provides notice when the pill dispenser was last used. This can serve as both a reminder that a pill has or has not been taken on schedule.

In the case where timely medication is important to the well being of the user, a highly reliable indicator is most desirable. This is also true in those cases where over medication or double dosages are to be avoided.

It is also desirable in some cases to ensure that only one pill is positively dispensed each time the dispenser is actuated.

Accordingly, a need exists for an inexpensive, reliable, hand-operated pill dispenser which provides a positive indication each time the dispenser is activated to release a pill.

Another need exists for a dispenser which positively controls the release of only one pill each time the dispenser is actuated.

A further need exists for such a dispenser which is particularly adapted for use once daily, and once activated provides a positive lock on an indicator to prevent over medication due to indicator slippage.

SUMMARY OF THE INVENTION

The present invention has been developed to fulfill the needs noted above and therefore has as an object the provision of a pill dispenser which provides a positive indication of use each time it is activated.

A further object is to provide such a dispenser in a compact form yet with a relatively large storage capacity.

Another object is to provide a pill dispenser with an index wheel which provides an indication of each use of the dispenser and which provides a lock on the wheel to prevent inadvertent over-medication.

Still another object of the invention is the provision of a pill dispenser having an inexpensive construction assembled with simple interference or snap-fit connections.

Yet another object of the invention is to provide a dispenser which positively controls the release of only one pill each time the dispenser is actuated.

These and other objects are met by the present invention which is directed to a hand-held, finger or thumb-activated pellet or pill container which provides on indication each time the container is opened. A sliding acuator driven by a user's thumb or the like actuates and drives three separate functions.

First, by sliding the actuator, a shutter or door opens a port in the container wall to allow a pill to be dispensed from within the container. At the same time, a finger or drive member driven by the actuator engages a cog on an index wheel causing the wheel to rotate over a predetermined arc. Third, as the index wheel turns, a pawl pivots away from and releases engagement with a second cog on the index wheel and snaps back into locking engagement with a third cog on the wheel.

A window in the container wall provides a view to a portion of the index wheel. Each time the container is actuated, a new indicator provided on the wheel, such as a day of the week, appears in the window indicating each use of the container.

In this manner, a user is reminded of each use and knows whether to take or refrain from taking additional medication. Because the index wheel is locked into each indexed position, it cannot rotate backward to provide an erroneous indication of last use. Only a positive movement of the actuator can move and change the indicator in the window.

A shuttle mechanism may be incorporated into the actuator to positively transfer only one pill from an internal feed spout to a dispensing port.

The aforementioned objects, features and advantages of the invention will, in part, be pointed out with particularity, and will, in part, become obvious from the following more detailed description of the invention, taken in conjunction with the accompanying drawings which form an integral part thereof.

DETAILED DESCRIPTION OF THE PREFERRED EMBODIMENTS

Figure 1:
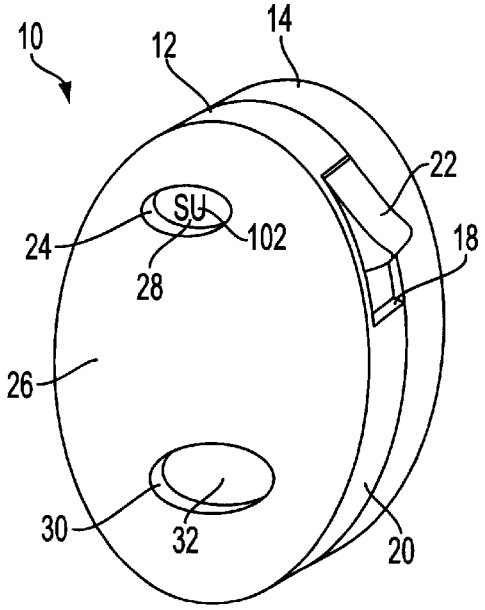
FIG. 1 is a perspective view of a dispenser constructed in accordance with the invention.

The present invention will now be described in conjunction with the drawings, beginning with FIG. 1 which shows a pellet dispenser 10, approximately actual size. As used throughout, the term pellet is intended to cover, pills, tablets, candy, as well as other dispensable objects.

Dispenser 10 includes a front, generally cup-shaped half casing 12 and a rear, generally cup-shaped half casing 14. The two half casing are detachably interconnected with a simple friction or interference fit provided by a tongue or lip 16 (FIG. 2) on the rear half-casing 14 which nests snugly within and against the inner walls of the front half casing 12.

An aperture 18 is formed in the side wall 20 of the front half casing to allow a trigger or thumb slide 22 to project outwardly from within the front casing. A break or opening 23 in lip 16 is also provided adjacent aperture 18 to provide clearance for the thumb slide. A view window 24 is formed in the front face 26 of the front half casing to allow viewing of a portion of the front face of an index wheel 28 mounted within the front half casing 12.

A dispensing port 30 is also formed in the front face 26 of the front half casing 12 to allow pellets to be dispensed from within the dispenser. As shown, a normally closed movable shutter 32 operated by thumb slide 22 covers the dispensing port 30 to prevent the contents of the dispenser from unintentionally falling out.

Figure 2:
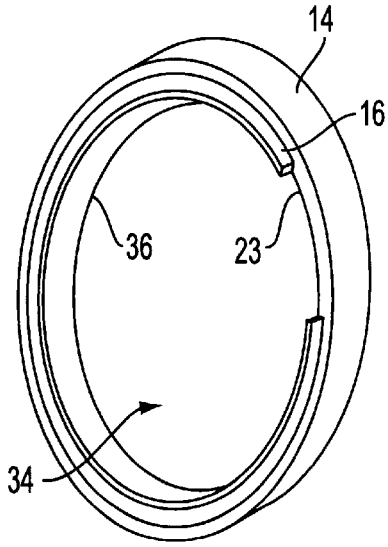
FIG. 2 is a perspective view of the storage compartment removed from the dispenser of FIG. 1.
Figure 3:
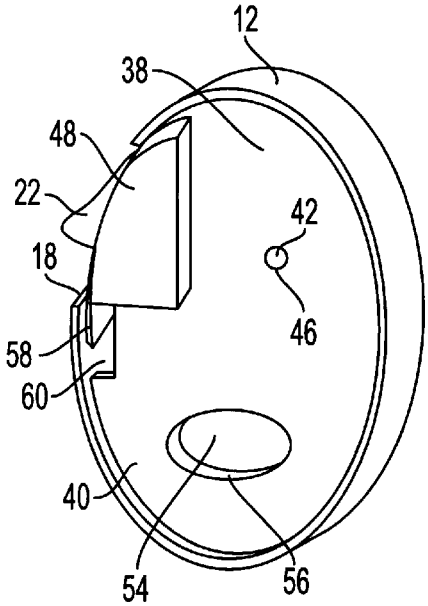
FIG. 3 is a perspective view of the actuator compartment of FIG. 1, with a partition wall in place, after removal of the storage compartment of FIG. 2.

As further seen in FIGS. 1 through 3, the rear half casing 14, when pressed into the front half casing 12, forms a relatively large rear storage compartment 34 (FIG. 2) between the inner rear wall 36 of the rear half casing 14 and the rear wall 38 of partition 40 (FIG. 3).

Partition 40 is press fit into the rear portion of the front half casing 12 and keyed into position by a peg 42 (FIG. 5) projecting from the rear or inner wall 44 of the front half casing 12 into an alignment hole 46 (FIG. 4) formed through the partition 40. A shield 48 is formed on the partition 40 to prevent the contents of the rear storage compartment from contacting the thumb slide 22.

When the partition is pressed in place as shown in FIG. 3, a front actuator compartment 50 (FIG. 5) is formed between inner wall 44 of the front half casing and the front wall 52 (FIG. 4) of partition 40. An opening 54 is formed through the partition 40 for allowing the contents of the rear storage compartment 34 to be dispensed through the front actuator compartment 50 and out port 30. A truncated spout 56 extends forwardly from the front wall 52 of the partition 40 and is aligned directly over port 30 such that, at rest, shutter 32 extends between and closes both port 30 and spout 56. Spout 56 and is slightly spaced apart from the inner wall 44 of the front half casing 12 to provide clearance for shutter 32.

Figure 4:
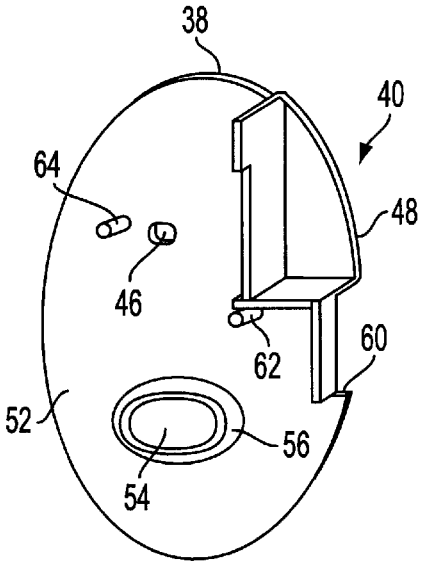
FIG. 4 is a perspective view of the partition wall as removed from FIG. 3.

A skirt 58 (FIG. 3) is provided on thumb slide 22 to normally block the lower portion of aperture 18. As seen in FIGS. 3 and 4, a recess 60 is formed in the outer edge of partition 40 to accommodate skirt 58.

A first guide peg 62 is provided on the front wall 52 of the partition 40 adjacent shield 48 and second guide peg 64 is provided on front wall 52 adjacent alignment hole 46. These pegs guide the movement of an actuator slide and ratchet pawl discussed below.

Figure 5:
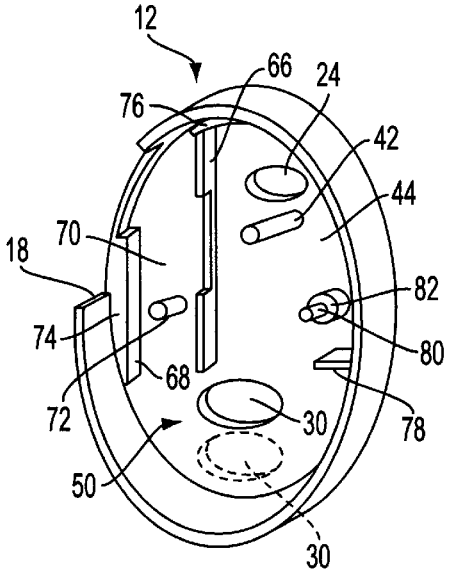
FIG. 5 is a perspective view of the actuator compartment of FIG. 3, after removal of the partition wall of FIG. 4, and for the purpose of clarity removal of all movable internal components.

Turning now to FIG. 5, the front casing 12 is formed with a first upstanding guide wall 66 and a second upstanding guide wall 68, each aligned generally parallel with one another. The first and second guide walls 66, 68 define a slideway 70 between them.

A guide post or pin 72 projects upwardly from wall 44 in the center of slideway 70. A raised sliding surface 74 extends from a central portion of aperture 18 to a point below the aperture to support and guide the movement of skirt 58 (FIG. 3) as the thumb slide 22 is actuated.

An arcuate shelf 76 provides support to partition 40 as well as proper spacing of the partition above inner wall 44. An upstanding support wall 78 extends upwardly from inner wall 44 to the same height as shelf 76 to further align and support partition 40 generally parallel to inner wall 44.

A stub shaft 80 projects from a flat circular support surface 82 raised above inner wall 44 of the front half casing 12. As discussed below, stub shaft 80 supports a pawl of a ratchet mechanism.

Figure 6:
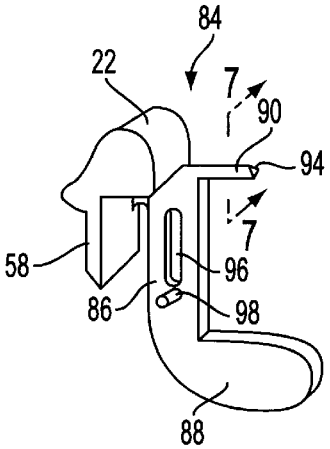
FIG. 6 is a perspective view of an actuator and shutter member removed from the actuator compartment of FIG. 5.

As seen in FIG. 6, the thumb slide 22 and skirt 58 are formed as part of an actuator 84 which may be formed as a single molded plastic component. Actuator 84 includes a flat slide bar 86 extending from thumb slide 22 to a door or shutter 88. Shutter 88 extends from the slide bar 86 at an approximate right angle so as to define a generally L-shaped profile with the slide bar.

Figure 7:
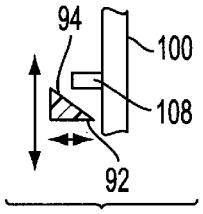
FIG. 7 is a sectional view taken through the drive member of FIG. 6 along line 7—7 thereof and schematically showing the relationship of the drive member with a cog on the index wheel of FIGS. 8 and 9.

An actuator finger or drive bar 90 extends at a right angle from the top of the slide bar 86 and extends generally parallel to the shutter 88. As seen in FIG. 7, slide bar 86 has a triangular or wedge-shaped cross section with flat face 92 configured to be aligned perpendicular to the surface of rear or inner wall 44. An inclined or ramped surface 94 extends upwardly with respect to rear or inner wall 44 and away from face 92 to provide a ratcheting action as discussed below.

Actuator 84 further includes a guide slot 96 extending longitudinally along a central portion of slide bar 86. When the actuator is mounted in the actuator compartment 50, guide pin 72 (FIG. 5) is inserted into guide slot 76 so as to align slide bar 86 centrally within slideway 70. A drive pin 98 projects upwardly from the slide bar 86 just below the guide slot 96.

Figure 8:
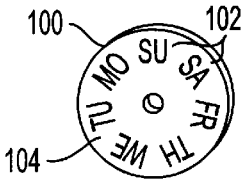
FIGS. 8 and 9 are respectively front and rear perspective views of an index wheel removed from the actuator compartment of FIG. 5.
Figure 9:
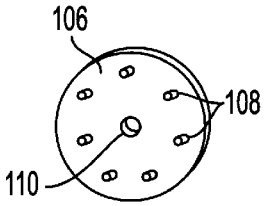

A flat circular index wheel 100 is shown in FIG. 8 to include circumferentially spaced indicia 102 on its front face 104. The rear face 106 of the indicia wheel 100, as seen in FIG. 9, is provided with a plurality of circumferentially space upstanding cogs 108.

The number of cogs 108 may equal the number of indicia 102 to provide for the proper registration and alignment of the indicia 102 within view window 24 (FIG. 1). A central bore 110 is formed through the index wheel for mounting the index wheel on peg 42 (FIG. 5).

Figure 10:
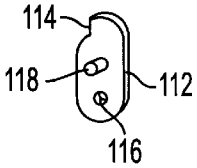
FIG. 10 is a perspective view of a ratchet pawl removed from the actuator compartment of FIG. 5.

As seen in FIG. 10, a pawl 112, which is adapted to be mounted in the actuator compartment 50, includes a recess 114 formed in one end portion for receiving and sequentially holding each cog 108 of the index wheel 100 as the dispenser 10 is actuated. Bore 116 is formed in the opposite end portion of the pawl for pivotally mounting the pawl on stub shaft 80 and raised support surface 82. A drive pin 118 projects outwardly at a right angle from the flat surface of pawl 112.

Figure 11:
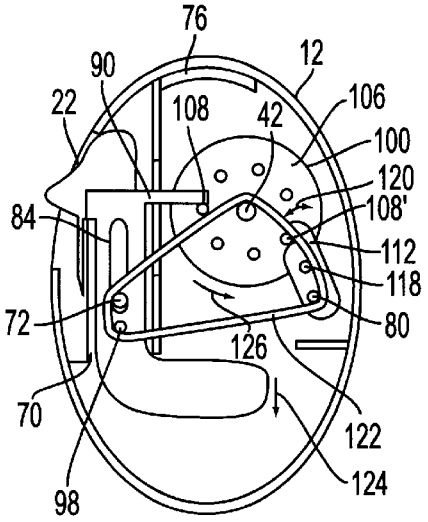
FIG. 11 is a plan view of the actuator compartment of FIG. 5, with all movable internal components shown in their normal unactuated positions.

When the partition 40 is removed from the front half casing 12, the dispenser, in its normal fully operable at rest position is arranged as shown in FIG. 11. The actuator 84 is slidably mounted in the slideway 70 and guided by guide pin 72. Index wheel 100 is rotatably mounted on peg 42.

Pawl 112, pivotally mounted on stub shaft 80 is arranged to pivot and slide over the rear face 106 of index wheel 100 as indicated by directional arrow 120. A drive belt or band 122, preferable formed of a resilient stretchable material such as plastic or rubber, transmits a driving force between the actuator 84 and pawl 112. In practice, an elastic or rubber band may be used as an inexpensive drive belt.

Belt 122 is stretched over peg 42, guide pin 72, drive pin 98, stub shaft 80 and drive pin 118. It should be noted that in use, i.e., when the dispenser is actuated from the position shown in FIG. 11 to the position shown in FIG. 12, belt 12 is subjected to elastic stretching only. Virtually no sliding movement of the belt takes place such that, except for stretching, the belt remains static.

Figure 12:
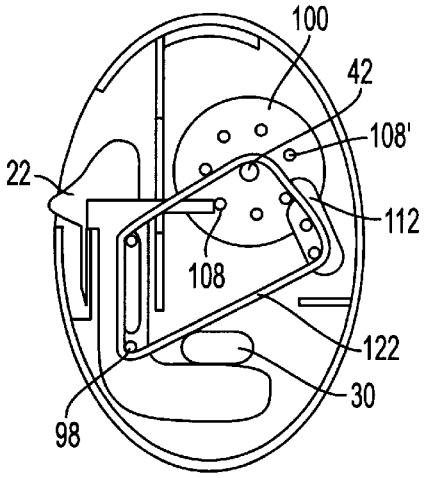
FIG. 12 is a view of FIG. 11 showing the actuator in its fully actuated position.

In order to operate the dispenser 10, all a user need do is slide the thumb slide 22 downwardly from its position in FIGS. 1 and 11, to its position in FIG. 12. This movement causes the actuator 84 to slide downwardly within slideway 70. This movement, as shown by directional arrow 124 in FIG. 11 causes the drive bar 90 to rotate the index wheel 100 in the direction of directional arrow 126.

During this movement, the flat face 92 of the drive bar 90 pushes cog 108 downwardly until the cog slides outwardly along drive bar 90 and out of engagement with face 92 to the position shown in FIG. 12. At this point, the index wheel is indexed one increment such that the next one of the indicia 102 appears sequentially in view window 24.

As the index wheel is indexed by drive bar 90, pawl 112 is pivoted over a small arc of several degrees away from the index wheel and its mounting peg 42. Once cog 108[1] (FIG. 11) clears the pawl 112, the pawl snaps back into engagement with the next cog (FIG. 12) and thereby prevents the index wheel 100 from backward (clockwise as shown) rotation.

The driving force for returning the pawl is provided by the elastic tension of belt 122 pushing drive pin 118 back to its original position as shown in FIG. 11. At this point, i.e., when the actuator is fully moved to the position of FIG. 12, the door or shutter 88 slides away from the dispensing port 30 and allows a user to remove one or more pellets from the storage compartment 34. A simple shaking movement allows one or more pellets to slide through spout 56 and out from port 30.

Once a pellet or pellets have been dispensed, the user need only release the thumb slide 22. Tension, provided by elastic stretching of belt 122, pulls on drive pin 98 to return the actuator 84 and thumb slide 22 back to the original rest position of FIG. 11. As seen in FIG. 7, when the returning drive bar 90 engages the next cog (at the 9 o'clock position in FIG. 12), the ramped surface 94 slides up and over the cog 108 and ratchets back in place on the opposite side of the cog as shown in FIG. 11.

When this ratcheting of drive bar 90 over cog 108 occurs, the index wheel 100 is prevented from clockwise rotation by pawl 112. Upon return of the actuator 84, the shutter closes dispensing port 30 and drive bar 90 further locks the index wheel in place. At this point the dispenser is ready for another activation according to any schedule indicated by indicia 102.

It can be appreciated that once a pellet has been dispensed, the index wheel displays the next indicia as a reminder or confirmation that a pellet has indeed been dispensed. If a user refers to the view window 24 and sees that the indicia is past due or indicates that the indicia is not current, the user knows that the dispensing of a pellet is overdue or that a pill has not been timely dispensed. The ratcheting between pawl 112 and cogs 108 prevents the index wheel from inadvertent movement and incorrect display of indicia.

Except for the drive belt 122, all components may be formed from relatively rigid molded plastic. The front and rear half casings, partition, actuator, index wheel and pawl may be formed inexpensively as injection molded plastic components.

Figure 13:
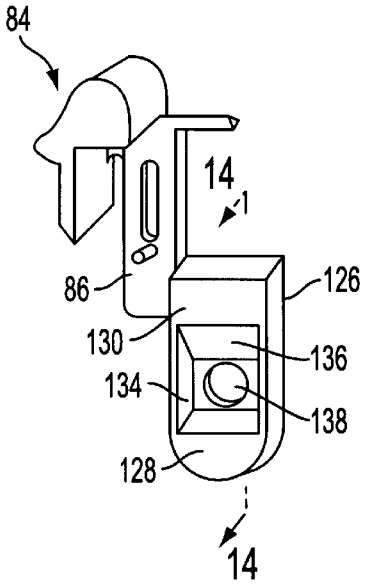
FIG. 13 is a perspective view of an alternate embodiment of the actuator of FIG. 6 modified to dispense a single pellet.
Figure 14:
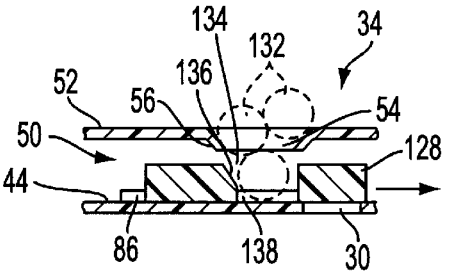
FIG. 14 is a schematic sectional view taken through the actuator of FIG. 13 along section line 14—14 and shown mounted at rest position within the dispenser of FIG. 1.
Figure 15:
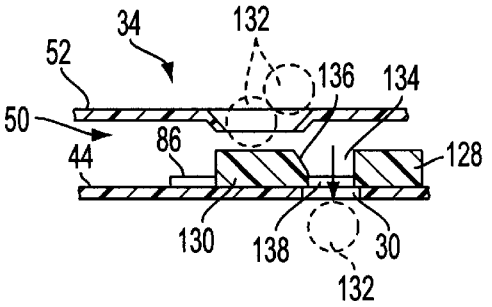
FIG. 15 is a view of the actuator of FIG. 14 in its actuated position showing the dispensing of a single pellet.

In some cases it is desirable to positively control and limit the release of pellets such that only a single pellet is released upon each actuation. This can be achieved by modifying the actuator 84 as shown in FIG. 13, reducing the height of spout 56 or eliminating spout 56 and moving the dispensing port 30 as shown in dashed lines in FIG. 5 and as depicted in FIGS. 14 and 15. The remaining construction of dispenser 10 may remain essentially unchanged as it has been described above.

As seen from a comparison of FIGS. 6 and 13, the shutter 88 of FIG. 6 has been replaced with a shuttle 126 which is molded and connected to slide bar 86. Shuttle 126 includes a first shutter portion 128, which as shown in FIG. 14, normally closes the dispensing port 30 in a manner similar to that of shutter 88 as described above.

A second shutter portion 130 is provided on shuttle 126 adjacent slide bar 86 for preventing pellets 132, as shown in FIG. 15, from entering the front actuator compartment 50 during actuation of the dispenser. A pocket 134 is formed in shuttle 126 between the first and second shutter portions 128, 130.

Pocket 134 is dimensioned to receive and transfer a single pellet 132, as shown in FIGS. 14 and 15, from the pellet storage compartment 34, via opening 54 and spout 56, to the dispensing port 30 in the direction of the directional arrow in FIG. 14. Pocket 134 serves as a shuttle or carriage which carries and slides each pellet over port 30 so that it may be ejected as represented in FIG. 15 by the directional arrow.

As seen in FIG. 14, a ramped surface 136 may be provided on the trailing wall of pocket 134 for directing each pellet toward a pellet release opening 138 sized to pass a single pellet out of the shuttle when actuated and positioned as shown in FIG. 15. The height of shuttle 136 is preferably such that alignment of the first and second shutter portions 128, 130 beneath opening 54 in spout 56 prevents the pellets 132 from entering the actuator compartment 50. If the height of the shutter portions 128, 130 is great enough, spout 56 may be eliminated.

In use, actuator 84 is operated in the same manner as described above. Prior to actuation, one pellet 132 typically is held within pocket 134. As the actuator 84 is activated by a user, the slide bar 86 and shuttle 126 slide from the position of FIG. 14 to that of FIG. 15. As opening 138 passes over dispensing port 30, a single pellet 132 is dispensed. Upon release of the actuator 84, the shuttle is returned to its rest position of FIG. 14 by the tension provided by drive belt 122. Pocket 134 is then repositioned beneath spout 56 to receive another pellet for the next dispensing operation.

There has been disclosed heretofore the best embodiment of the invention presently contemplated. However, it is to be understood that various changes and modifications may be made thereto without departing from the spirit of the invention.

What is claimed is:

1. A pellet dispenser, comprising:

a storage compartment for storing pellets;

an actuator compartment connected to said storage compartment, said actuator compartment having a dispensing port formed therein;

a partition disposed between said storage compartment and said actuator compartment, said partition comprising an opening for passing said pellets through said storage compartment;

a movable door disposed in said actuator compartment over said dispensing port and aligned with said opening in said partition; and an index wheel disposed in said actuator compartment and indexed during movement of said door.

2. The dispenser of claim 1, further comprising a manual actuator disposed at least in part within said actuator compartment and connected to said door.

3. The dispenser of claim 1, further comprising an elastic belt transmitting tension between said door and said index wheel.

4. The dispenser of claim 1, further comprising a ratchet assembly engaged with said index wheel.

5. The dispenser of claim 1, further comprising a spout extending between said opening and said door.

6. The dispenser of claim 1, further comprising a slideway provided in said actuator compartment, and wherein movement of said door is guided by said slideway.

7. The dispenser of claim 1, further comprising a window provided in said actuator compartment and aligned over said index wheel.

8. The dispenser of claim 1, further comprising a drive member movable with said door for rotating said index wheel.

9. The dispenser of claim 1, further comprising a shuttle movable with said movable door for transferring a pellet from said opening in said partition to said dispensing port.

10. A pellet dispenser, comprising:

a pellet compartment having a plurality of pellets disposed therein;

a dispensing port communicating with said pellet compartment;

a sliding shutter slidably mounted over said dispensing port and separated from said pellet compartment;

a manual actuator connected to said shutter for sliding said shutter back and forth across said dispensing port; and a resilient member biasing said shutter over said dispensing port.

11. The dispenser of claim 10, further comprising an index wheel rotatably mounted within said dispenser and driven by said actuator.

12. The dispenser of claim 11, further comprising a drive member having a flat engagement surface and a ramped engagement surface, each said surface for engaging said index wheel.

13. The dispenser of claim 11, further comprising a pawl pivotally mounted within said dispenser and biased into engagement with said index wheel by said resilient member.

14. The dispenser of claim 12, wherein said index wheel comprises seven cogs selectively engageable with said pawl.

15. The dispenser of claim 10, further comprising a pair of cup shaped half casings releasably interconnected by a circumferential tongue and groove interference fit.

16. The dispenser of claim 15, further comprising a partition disposed between said half casings.

17. The dispenser of claim 10, further comprising a shuttle movable with said shutter for transferring a pellet from said pellet compartment to said dispensing port.

18. The dispenser of claim 10, wherein said resilient biasing member comprises an elastic band.

19. The dispenser of claim 10, further comprising a slideway provided within said dispenser for guiding movement of said shutter.

20. The dispenser of claim 19, further comprising a guide pin located within said slideway and wherein said actuator has a slot formed therein receiving said guide pin.

21. A pellet dispenser, comprising:

a pellet compartment disposed within said dispenser, a partition extending over said pellet compartment;

an actuator compartment disposed within said dispenser and separated from said pellet compartment by said partition;

a dispensing port communicating with said pellet compartment;

a shutter disposed within said actuator compartment and slidably mounted over said dispensing port;

a manual actuator disposed in part within said actuator compartment and connected to said shutter; and a resilient member biasing said shutter over said dispensing port.

22. A pellet dispenser, comprising:

a pellet compartment;

a dispensing port communicating with said pellet compartment;

a shutter slidably mounted over said dispensing port;

a manual actuator connected to said shutter;

a resilient member biasing said shutter over said dispensing port; and an index wheel rotatably mounted within said dispenser and rotated about its center by said actuator.

* * * * *